US005685708A

United States Patent [19]

Palmer-Jones

[11] Patent Number: 5,685,708

[45] Date of Patent: Nov. 11, 1997

[54] FUEL FIRED BURNERS

[75] Inventor: Roland Vincent Horatio Palmer-Jones, Nottingham, Great Britain

[73] Assignee: British Gas plc, London, England

[21] Appl. No.: 489,626

[22] Filed: Jun. 12, 1995

[30] Foreign Application Priority Data

Jun. 16, 1994 [GB] United Kingdom ..... 9412077

[51] Int. Cl.[6] ..... F23D 14/16

[52] U.S. Cl. ..... 431/328; 431/114

[58] Field of Search ..... 431/7, 170, 326, 431/114, 328, 350, 354, 353

[56] References Cited

U.S. PATENT DOCUMENTS

| | | | |
|---|---|---|---|
| 1,968,978 | 8/1934 | White | 431/328 |
| 3,231,202 | 1/1966 | Milligan | 431/328 |
| 3,258,058 | 6/1966 | Lherault et al. . | |
| 3,277,948 | 10/1966 | Best | 431/328 |
| 5,525,056 | 6/1996 | Sutton | 431/328 |

FOREIGN PATENT DOCUMENTS

| | | | |
|---|---|---|---|
| 0583961 A1 | 2/1994 | European Pat. Off. . | |
| 0022111 | 1/1986 | Japan | 431/328 |
| 226772 | 6/1969 | U.S.S.R. | 431/328 |
| 2272508 | 5/1994 | United Kingdom | 431/354 |

*Primary Examiner*—Carl D. Price

*Attorney, Agent, or Firm*—Oblon, Spivak, McClelland, Maier & Neustadt, P.C.

[57] ABSTRACT

A fuel fired burner is provided for receiving a premixture of fuel and air. A ceramic flame support extends across the burner chamber and has a plurality of elongate slots through which the fuel and air flows. Each slot has a narrow constant dimension portion that opens into a wider constant dimension portion. The outlet end of the latter portion opens into a short diverging outlet. The arrangement is such that when the burner is operating within a given heat output range, the burner flame can move between the upstream and downstream ends of the diverging outlet to seek stabilization as the heat output changes within that range, without retracting into the slot upstream of the outlet.

18 Claims, 4 Drawing Sheets

FUEL FIRED BURNERS

FIELD OF THE INVENTION

1. Field of the Invention

The present invention relates to a fuel-fired burner, and particularly a gas-fired burner, which preferably is of the fully premixed type, i.e. one in which the fuel gas is mixed with all the combustion air in a mixing chamber before the gas is combusted.

2. Discussion of the Background

One kind of fully premixed burner comprises a plenum chamber into which an externally prepared mixture of air and fuel gas, such as natural gas, is introduced before being discharged more or less uniformly through slots or ports in a flame support, block, plate or strip which may or may not form a part or wall of the chamber. The mixture is combusted at a point within or downstream of the support, block, plate or strip, to produce combustion products. The combustion products may then enter a first enclosure leading to a second enclosure such as a heat exchanger when the burner is used as a heat source in a heating appliance, such as a boiler. A fully premixed burner is described, by way of illustration, in our published UK Patent Application No. 2176588A.

A problem with burners of this kind is that there is a tendency under certain conditions for them to generate unacceptable intensities of so-called resonant combustion noise (combustion driven oscillations), particularly when enclosed in a heating appliance and when the burner is operated at a relatively high heat output per unit of burner surface area.

SUMMARY OF THE INVENTION

An object of the invention is to provide a burner in respect of which the likelihood of resonant combustion noise is alleviated or reduced.

According to one aspect of the invention there is provided a fuel fired burner comprising a chamber for receiving a premixture of fuel and air, and a flame support extending across the chamber and having a plurality of elongate through slots, each slot having a portion of relatively narrow substantially constant dimension which opens, in a downstream direction, into a portion of a relatively wide substantially constant dimension, the downstream end of each relatively wide substantially constant dimension portion opens into a short diverging outlet which forms the downstream end portion of the associated slot, the angle of divergence and the length of the diverging outlet being such that when the burner is operating within a given heat output range for the burner, the burner flame can move between the upstream and downstream ends of the outlet to seek stabilization as the heat output changes within that range, without retracting into the slot upstream of the diverging outlet.

The terms 'downstream' and 'upstream' should be understood by having regard to the intended direction of flow of the premixture through the flame support.

The relatively narrow substantially constant dimension slot portion serves to determine the flow rate of the premixture through the flame support, given a particular pressure. Typically the width of this portion may be in the range from 0.3 mm to 2.0 mm, and typically the length of this portion may be in the range from 2.0 mm to 10.0 mm.

The relatively wide substantially constant dimension slot portion serves to reduce the likelihood of turbulence of the premixture passing through this section of the slot, and thus to reduce or eliminate combustion noise. Typically, the width of this portion may be in the range from 2.0 mm to 10.0 mm, and typically the length of this portion may be in the range from 20 mm to 100 mm.

The short diverging outlet which terminates the end of the slot is sufficiently long to enable the flame to stabilize and 'sit' or be located at or adjacent the very top or wider end of the diverging outlet when the heat output of the burner is at the upper end of the given heat output range, and to enable the flame to stabilize and 'sit' or be located within the diverging outlet when the heat output of the burner is at the lower end of the given heat output range. Typically, the length of the short diverging outlet may be in the range from 2.0 to 10.0 mm. The width of the diverging outlet at its downstream end may, typically, be in the range from 3.0 mm to 15.0 mm such that the ratio of the length of the short diverging outlet to the width dimension thereof at its downstream end is from 0.66 to 1 to 3.33 to 1.

Preferably, each slot has a converging inlet portion having a downstream end which is also, or coincides with, the upstream end of the relatively narrow substantially constant dimension portion. Typically, the length of this portion may be in the range from 2.0 mm to 15.0 mm, and typically the width of the upstream end of this portion may be in the range from 2.0 mm to 15.0 mm. The converging inlet portion serves to reduce flow turbulence in the slot and reduce the likelihood or extent of resonance, since Applicants believe that flow turbulence in the slot contributes to or causes resonance.

Over the length of each converging inlet portion the angle of convergence may be substantially constant, that is each side wall of the portion is substantially flat or straight. Alternatively, each converging inlet portion may have a varying angle of convergence, for example of convex elliptical form, as indicated by dotted lines 102 in FIG. 3.

Preferably, each relatively narrow substantially constant dimension portion leads to the relatively wide substantially constant dimension portion by means of an intermediate slot portion which diverges from the downstream end of the relatively narrow portion to the upstream end of the relatively wide portion. Typically, the length of this intermediate slot portion may be in the range from 3.0 mm to 20.0 mm. Over the length of each intermediate slot portion the angle of divergence may be substantially constant, that is each side wall of the portion is substantially flat or straight. The provision of such an intermediate diverging slot portion avoids or eliminates sudden expansion of the premixture of gases as they pass from the relatively narrow portion into the relatively wide portion to prevent the formation of turbulent eddies and vortices.

According to another aspect of the invention there is provided a flame support for use in a fuel fired burner, which flame support comprises a plurality of elongate through slots, each slot having a portion of relatively narrow substantially constant dimension which opens, in a downstream direction, into a portion of relatively wide substantially constant dimension, the downstream end of each relatively wide substantially constant dimension portion opens into a short diverging outlet which forms the downstream end portion of the associated slot, the angle of divergence and the length of the diverging outlet being such that when the flame support is incorporated in the burner and the burner is operating within a given heat output range for the burner, the burner flame can move between the upstream and downstream ends of the outlet to seek stabilization as the heat output changes within that given range, without retracting into the slot upstream of the diverging outlet.

Conveniently, the slots are defined between flame support elements located or arranged side by side, thereby providing a flame support of modular construction.

According to a further aspect of the invention there is provided a flame support element which is adapted to be located or arranged side by side with similar elements to form a flame support as defined above. It will be appreciated that different numbers of same sized elements can be assembled or arranged together to produce flame supports of modular construction and of different sizes for inclusion in a range of differently rated burners.

Conveniently, each flame support element comprises end parts which also serve as spacers and are intended to abut or engage with corresponding end parts of a similar element placed next to it to define a said slot therebetween.

BRIEF DESCRIPTION OF THE DRAWINGS

The invention will now be further described, by way of example only, with reference to the accompanying drawings, in which.

DESCRIPTION OF THE PREFERRED EMBODIMENTS

Figure 1:
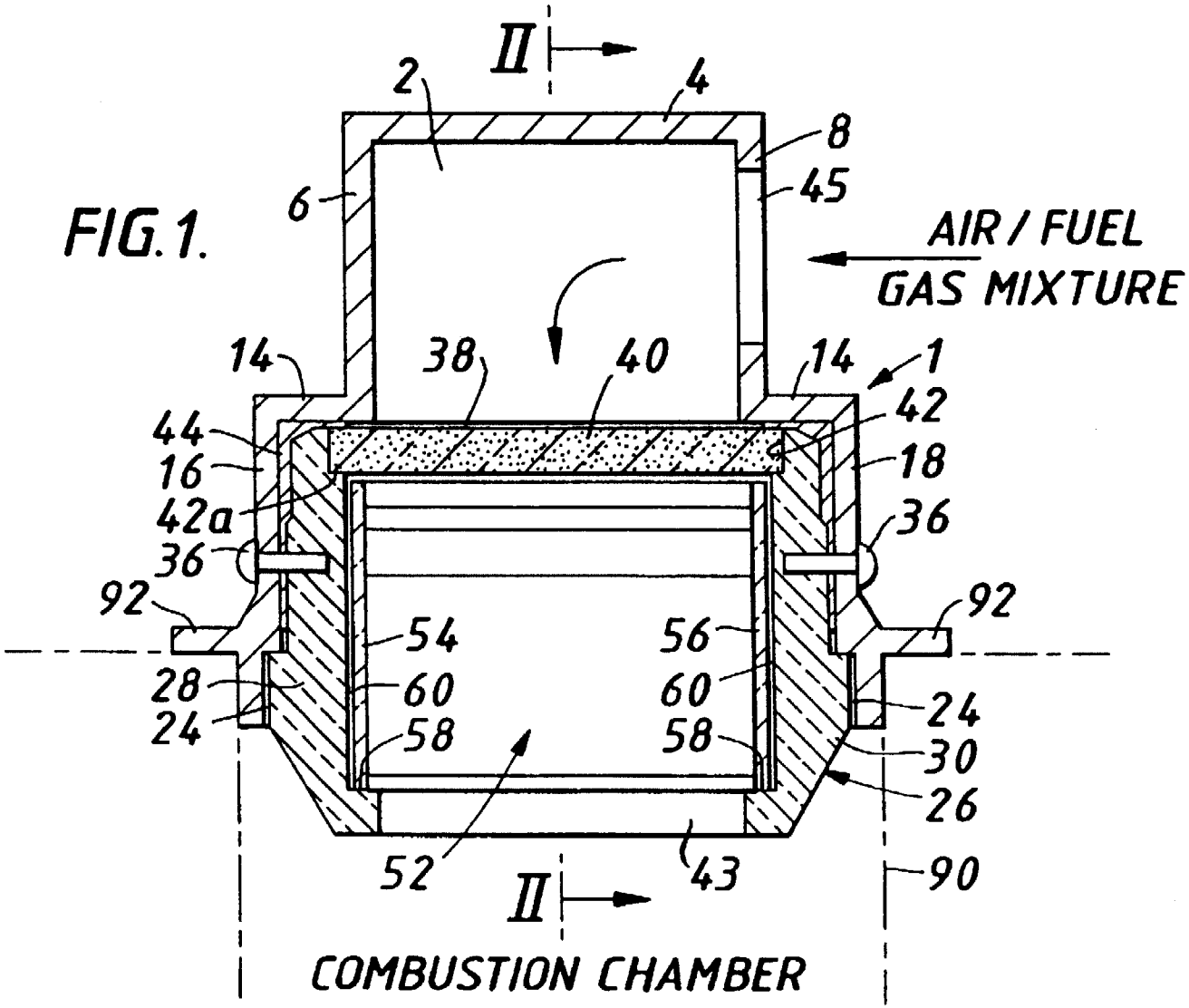
FIG. 1 is a sectional view of one embodiment of burner according to the invention.
Figure 2:
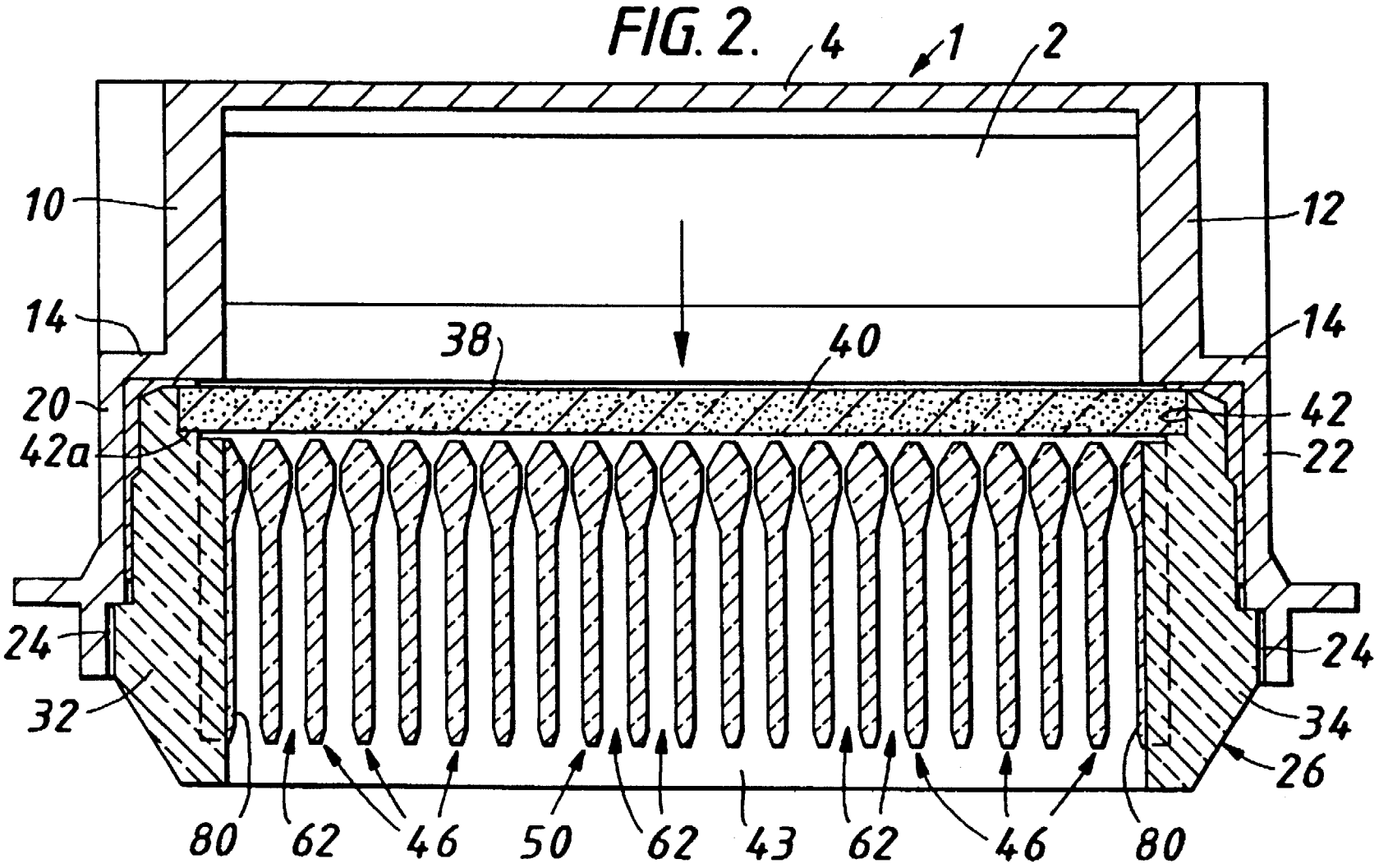
FIG. 2 is a cross-sectional view of the burner taken on the line II—II in FIG. 1.

Referring to the drawings, FIGS. 1 and 2 in particular, a gas-fired burner 1 of the fully premixed kind is shown in a downwardly firing mode. The burner 1 comprises an elongated upper chamber serving as a plenum chamber 2 defined in part by a top horizontal wall 4, two vertical side walls 6 and 8, and two vertical end walls 10 and 12. A peripheral wall 14 extends horizontally outwardly from the lower ends of the walls 6, 8, 10 and 12. From the outer edge of the peripheral wall 14 there extends downwardly two vertical side walls 16 and 18 and two end walls 20 and 22 to form a lower chamber or enclosure which is of generally rectangular cross-section in both the horizontal and vertical planes and which has an opening 24 at the bottom.

A hollow, generally rectangular support member 26 having vertical side walls 28 and 30 and end walls 32 and 34, is mounted within the lower chamber by means of securing pins 36 which extend through the side walls 16 and 18 of the enclosure into the side walls 28 and 30 of the support member 26.

A rectangular porous fuel gas/air distribution plate 40 extends across the opening 38 at the top of the support member 26. The plate is supported on a horizontal shoulder portion 42*a* of a recess 42 extending around the inside of the support member. At the bottom of the support member 26 there is an opening 43.

A seal 44 is sandwiched on the one hand between the side and end walls 28, 30, 32, 34 of the support member 26 and the side and end walls 16, 18, 20, 22 of the enclosure, and on the other hand between the upper ends of the side and end walls 16, 18, 20, 22 of the enclosure, and the underside of the peripheral wall 14. As can be seen from FIGS. 1 and 2 the seal 44 is also sandwiched between the upper peripheral edge portions of the distribution plate 40 and the underside of the peripheral wall 14.

The porous distribution plate 40 provides a lower wall to the plenum chamber and can serve as a flame trap should the burner malfunction for any reason and lightback occur.

Entry of air/fuel gas premixture to the plenum chamber 2 is via an inlet 45 in the side wall 8 of the chamber 2.

A plurality of discrete flame support elements 46, made of ceramic material, located side by side and mounted within the lower chamber below the distribution plate 40, form a flame support 50 which in effect provides a slotted ceramic wall across the chamber. It will be appreciated that the ceramic material should have appropriate good thermal-shock resistance and low thermal expansion.

Figure 4:
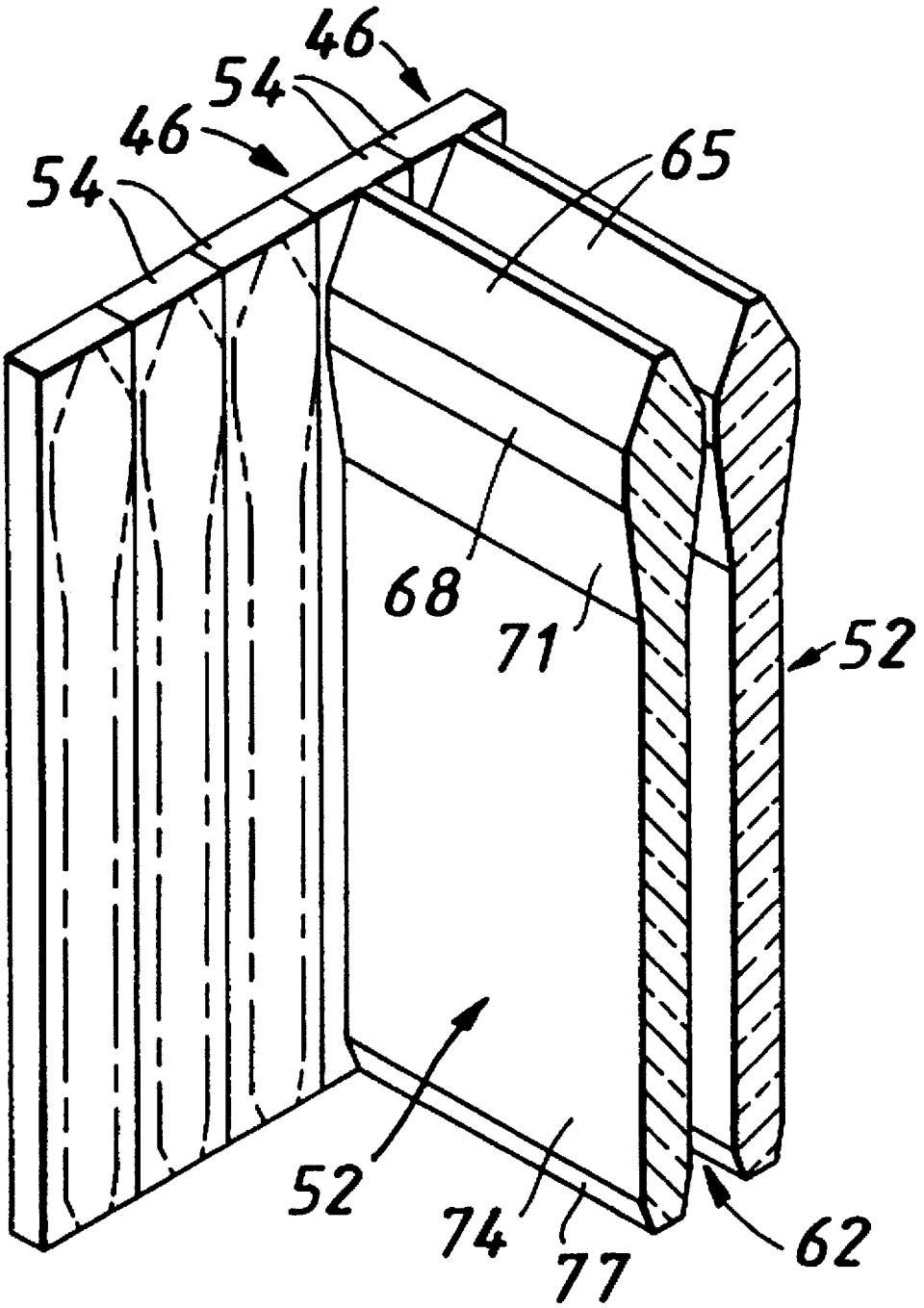
FIG. 4 is a perspective view partly in section showing adjacent flame support elements arranged side by side and defining therebetween one of the elongate through slots.

Each element 46 comprises a wall 52 bridging or intermediate opposite end parts 54, 56 as seen in FIGS. 1 and 4. The end parts are supported on opposite sides of the chamber by the shoulder 58 of a recess 60 which extends around the inner periphery of the support member 26.

The flame support elements 46 are arranged so that the walls 52 are generally parallel (as viewed in FIGS. 1 and 2) and are equally spaced in a row throughout the length of the flame support. Adjacent walls 52 define therebetween a plurality of burner ports in the form of parallel elongate slots 62 that extend generally vertically through the flamestrip.

Each end of the part 54, 56 is in the form of a rectangular block. Corresponding end parts of adjacent elements 46 abut each other and serve as spacers to ensure that the slot 62 defined therebetween has the desired dimensions. Each wall 52 has an upper tapered portion 64 having flat or straight side surfaces 65 and 66 diverging downwardly to a relatively wide and short portion 67 having parallel sides 68 and 69. From the lower end of the parallel sided portion 67 the wall 52 has a portion 70 which has flat or straight side surfaces 71 and 72 and tapers downwardly to a relatively narrow and long portion 73 having parallel sides 74 and 75. A short downwardly tapering portion 76 having flat or straight sides 77 and 78 extends from the bottom end of the parallel sided portion 73 to terminate the lower end of the wall 52.

It will be seen from FIGS. 1 and 2 that each end of the row of walls 52 terminates in a half profiled wall 80. The plurality of equivalent, equispaced elongate slots 62 is defined between adjacent walls 52, or a wall 52 and adjacent half profiled wall 80. The slots 62 serve as ports for fuel gas/air premixture for subsequent ignition as will be described below.

Figure 3:
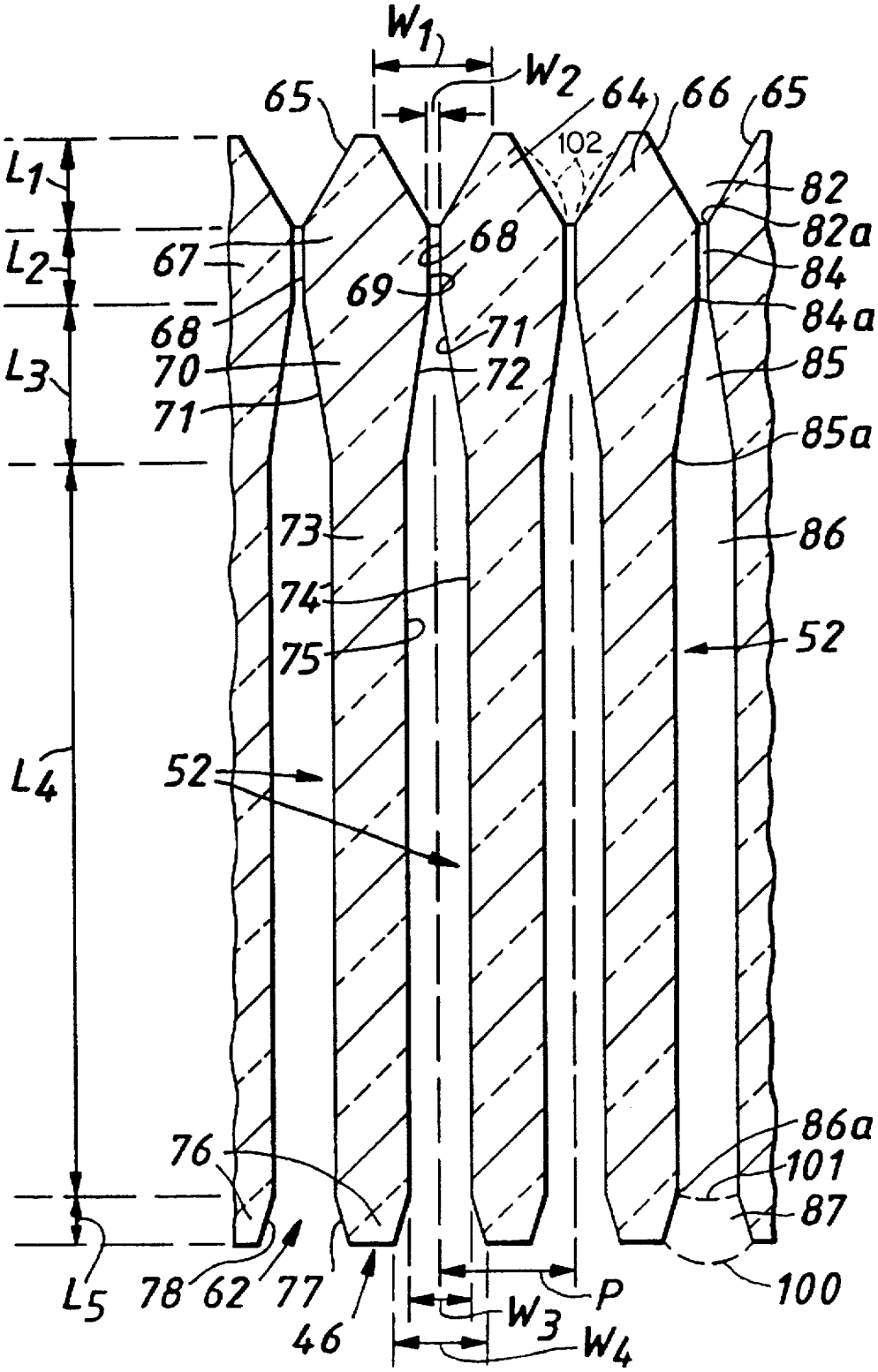
FIG. 3 is a sectional view on an enlarged scale of part of the flame support as shown in FIG. 2.

Referring to FIG. 3, each slot 62 has an inlet portion 82 which is defined between adjacent sides 65 and 66 of the upper wall portions 64 and converges to an end 82*a* which is also, or coinsides with, the upstream end of a relatively narrow substantially constant dimension straight portion 84 defined between adjacent parallel wall sides 68 and 69. A slot portion 85 defined between adjacent wall sides 71 and 72 diverges from the downstream end 84*a* of the relatively narrow portion 84, to a downstream end 85*a* which is also the upstream end of a relatively wide substantially constant dimension portion 86 which is defined between adjacent parallel wall sides 74 and 75. The downstream end 86*a* of the relatively wide portion 86 opens into a short diverging outlet 87 which is outwardly tapered and is defined between the adjacent flat wall sides 77 and 78, and which forms the downstream end portion of the slot 62. It will be seen that the downstream end 86*a* of the relatively wide portion 86 is also the upstream end of the short diverging outlet 87.

In the ready-for-use condition, the assembly of components described above is mounted on a combustion chamber 90 as shown in chain-dotted lines in FIG. 1 by means of an apertured flange 92 which extends outwardly from and around the walls 16, 18, 20, 22 forming the enclosure.

In use, a premixture of fuel gas (natural gas) and air is supplied by way of the inlet 45 to the plenum chamber 2. The mixture then passes through the porous plate 40 which distributes the mixture uniformly and at a relatively low intensity of turbulence to the slotted burner flame support 50.

After passing through the slots 62 the air/gas mixture is ignited by ignition means (not shown), for example spark electrodes, so as thereafter to combust steadily, without further assistance from the ignition means, in the vicinity of the short diverging outlet 87, without being upstream of the upstream end 86*a* of the diverging outlet 87, that is without being within the constant dimension portion 52. The burner fires downwardly through the opening 43 into the combustion chamber 90 with the position of the flame along the outlet 87 being dependent upon the composition and rate of flow of the air/gas mixture through the flamestrip.

The dimensions of the features of the flame support elements and flame support, for a given or intended environment, enclosure or combustion chamber, and composition of fuel gas, are chosen so that the burner can operate as intended, within a given or recommended heat output range for the burner.

By way of example only, in a ceramic flame support arrangement used by the Applicants in experiments, dimensions were as follows having regard to the reference letters in FIG. 3:

Width of upstream end of converging inlet portion 82=$W_1$=6.3 mm.

Width of relatively narrow substantially constant dimension portion 84 (which is also the width of the downstream end 82*a* of inlet portion 82 and the width of the upstream end 84*a* of the diverging portion 85)=$W_2$=0.6 mm.

Width of relatively wide substantially constant dimension portion 86 (which is also the width of the downstream end 85*a* of the diverging portion 85 and the width of the upstream end 86*a* of the diverging outlet 87)=$W_3$=3.3 mm.

Width of downstream end of diverging portion 87 (which coincides with the downstream end of slot 62)=$W_4$=4.2 mm.

Pitch of the slots 62 through the burner flame support 50=P=7.3 mm.

Length of the converging inlet 82=$L_1$=5 mm.

Length of the relatively narrow substantially constant dimension portion 84=$L_2$=3 mm.

Length of the intermediate diverging portion 85=$L_3$=10 mm.

Length of the relatively wide substantially constant dimension portion 86=$L_4$=40 mm.

Length of the diverging outlet 87=$L_5$=2.5 mm.

Length of the flame support 50 (as shown in FIG. 2)=146 mm.

Breath of the slots 62 (and approximate breath of the flame support)=70 mm.

The air/natural fuel gas mixture used had an aeration of 140% of stoichiometric requirements.

In Applicants experiments it was found that for a given or recommended heat input range from 5 KW to 20 KW to the flame support no, or substantially no, resonance occurred. This provides the burner with a so-called turn-down ratio of about 4:1. When using this range, when the heat output was at the maximum level the flame stabilized or 'sat' at the wider downstream end of the outlet 87 as shown schematically at 100 in FIG. 3. As the heat output was reduced towards the minimum level of the given range, the flame position retracted towards the upstream end of the outlet 87 until, with the heat output at the minimum of the given range, the flame stabilized or 'sat' at, or closely adjacent to, the narrower upstream end 86*a* of the outlet as shown schematically at 101 in FIG. 3, but without retracting into the portion 52 of the slot 62 which is upstream of the end 86*a*.

Applicants investigations involving burner ports or slots have shown that, for a given flow rate of air/fuel gas mixture through the ports, longer or more pointed, flames can be viewed as 'stretched' flames and are associated with relatively high resonance noise while 'flatter' flames are associated with no or much less resonance noise.

Applicants believe that were it not for the diverging outlet 87 the flame would become 'stretched', that is increasingly long or pointed, as the heat output was raised towards the maximum of the given range. Since the width of the outlet 87 increases in the downstream direction, the shape of the flame is kept 'flatter' as the flame takes up positions of increasing width as the rate of flow of air/fuel gas mixture through the flame support and thus the heat output is increased.

Applicants experiments showed that if the diverging outlet 87 was absent, so that the downstream end of the slot 62 terminated with the end of the substantially constant dimension portion 86, the flame became 'stretched' within the given heat output range and significant resonance resulted.

Applicants experiments also showed, given that everything else remained the same, that if the length of the diverging outlet ($L_5$) was increased beyond a certain amount, the flames tended undesirably to 'pull' or 'retract' back into the portion 87 at a relatively high heat output within the given range. It is believed that this is because as the flame moves into this longer diverging outlet it heats up the side walls of the outlet. This heat is then conducted back or upstream via the side walls into the ceramic material of the elements 46 resulting in the air/fuel gas mixture being preheated and the burning velocity increasing, and causing the mixture to burn at a more upstream position in the slot 62. In addition, it seemed that the high temperature attained by the side walls of this longer diverging outlet prevented the flame moving to a relatively wider position within the diverging outlet than was obtainable with the 5 mm outlet. This relative increased retention of the flame for a given heat output was considered to be at least in part the cause of the significant amount of resonance found using this longer diverging outlet.

For a premixed burner to operate at high gas rate, i.e. with high heat output intensity, and with a relatively low likelihood of resonance occurring, the port or slot loading should also be low, for a given heat output, to reduce the likelihood of forming 'stretched' flames. Applicants achieve this by having the relatively wide constant dimension slot portion and the diverging outlet for low port loading and closely pitched slots. The Applicants burner flame support as described above has a large open area (i.e. port area), >50% of overall area of the downstream face of the flame support at or adjacent which the flame burns.

Applicants experiments with the example of a preferred premixed burner as described above, resulted in low emission levels of $NO_x$ and other pollutants.

I claim:

1. A fuel fired burner, comprising:

a chamber receiving a premixture of fuel and air, and a flame support extending across the chamber and having a plurality of elongate through slots, each slot having a portion of relatively narrow substantially constant dimension which opens, in a downstream direction, into a portion of relatively wide substantially constant dimension, wherein a downstream end of each relatively wide substantially constant dimension portion opens into a short diverging outlet which forms a downstream end portion of an associated slot, said diverging outlet being outwardly tapered, a length dimension of the diverging outlet being such that when the burner is operating within a given heat output range for the burner, the burner flame is movable between upstream and downstream ends of the outlet to seek stabilization as heat output changes with said range, without retracting the burner flame into the slot upstream of the diverging outlet.

2. A burner as claimed in claim 1, wherein each slot has a converging inlet portion having a downstream end which also comprises an upstream end of the relatively narrow substantially constant dimension portion.

3. A burner as claimed in claim 2, wherein, over a length dimension of the converging inlet portion, an angle of convergence of the converging inlet is substantially constant.

4. A burner as claimed in claim 2, wherein each converging inlet portion has a varying angle of convergence.

5. A burner as claimed in claim 4, wherein the converging inlet portion is of a convex elliptical form.

6. A burner as claimed in any of claims 1 to 5, wherein each relatively narrow substantially constant dimension portion leads to the relatively wide substantially constant dimension portion by an intermediate slot portion which diverges from the downstream end of the relatively narrow substantially constant dimension portion to the upstream end of the relatively wide substantially constant dimension portion.

7. A burner as claimed in claim 1, wherein the slots are defined between discrete flame support elements located or arranged side by side.

8. A burner as claimed in claim 1, wherein a ratio of the length dimension of the diverging outlet to a width dimension at a downstream end thereof is from 0.66 to 1 to 3.33 to 1.

9. A flame support for use in a fuel fired burner, which flame support comprises:

a plurality of elongate through slots, each slot having a portion of relatively narrow substantially constant dimension which opens, in a downstream direction, into a portion of relatively wide substantially constant dimension, wherein a downstream end of each relatively wide substantially constant dimension portion opens into a short diverging outlet which forms a downstream end portion of an associated slot, said diverging outlet being outwardly tapered, and a length of dimension of the diverging outlet being such that when the flame support is incorporated in the burner and the burner is operating within a given heat output range for the burner, the burner flame is movable between upstream and downstream ends of the outlet to seek stabilization as heat output changes within said given range, without the burner flame retracting into a slot upstream of the diverging outlet.

10. A flame support as claimed in claim in claim 9, wherein each slot has a converging inlet portion having a downstream end which is also an upstream end of the relatively narrow substantially constant dimension portion.

11. A flame support as claimed in claim 10, wherein over a length dimension of the converging inlet portion, an angle of convergence of the converging inlet portion is substantially constant.

12. A flame support as claimed in claim 10, wherein each converging inlet portion has a varying angle of convergence.

13. A flame support as claimed in claim 12, wherein the converging inlet portion is of a convex elliptical form.

14. A flame support as claimed in any of claims 9 to 13, wherein each relatively narrow substantially constant dimension portion leads to the relatively wide substantially constant dimension portion by an intermediate slot portion which diverges from a downstream end of the relatively narrow substantially constant dimension portion to an upstream end of the relatively wide substantially constant dimension portion.

15. A flame support as claimed in claim 9, in which the slots are defined between flame support elements located or are arranged side by side.

16. A flame support element which is adapted to be located or arranged side by side with similar elements to form a flame support as claimed in claim 9.

17. A flame support element as claimed in claim 16, comprising end parts which also serve as spacers and are intended to abut or engage with corresponding end parts of a similar element placed next to it to define a said slot therebetween.

18. A flame support as claimed in claim 9, wherein a ratio of the length dimension of the diverging outlet to a width dimension at its downstream end thereof is from 0.66 to 1 to 3.33 to 1.

* * * * *